US009234336B2

(12) United States Patent
Yang

(10) Patent No.: US 9,234,336 B2
(45) Date of Patent: Jan. 12, 2016

(54) ROTATABLE COUNTERWEIGHT ASSEMBLY

(71) Applicant: Globe Union Industrial Corp., Taichung (TW)

(72) Inventor: Chaota Yang, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 14/533,152

(22) Filed: Nov. 5, 2014

(65) Prior Publication Data

US 2015/0233097 A1 Aug. 20, 2015

(30) Foreign Application Priority Data

Feb. 17, 2014 (CN) ..... 2014 1 0052585

(51) Int. Cl.
*E05F 1/00* (2006.01)
*E05F 3/00* (2006.01)
*E03C 1/04* (2006.01)

(52) U.S. Cl.
CPC ..... *E03C 1/0404* (2013.01); *E03C 2001/0415* (2013.01); *Y10T 16/82* (2013.01)

(58) Field of Classification Search
CPC ... Y10T 16/82; Y10T 16/95; Y10T 137/9464; A63B 69/3638; A63B 69/3632; E03C 1/04; E03C 2001/0415
See application file for complete search history.

(56) References Cited

U.S. PATENT DOCUMENTS

| | | | | | |
|---|---|---|---|---|---|
| 2,115,814 | A * | 5/1938 | Jensen | 74/591 |
| 4,588,191 | A * | 5/1986 | Stewart | 473/256 |
| D290,150 | S * | 6/1987 | Stewart | D21/759 |
| 5,311,909 | A * | 5/1994 | Adcock | 137/899 |
| 5,771,934 | A * | 6/1998 | Warshawsky | 137/801 |
| 6,250,338 | B1 * | 6/2001 | Dempsey | 138/103 |
| 6,460,570 | B1 | 10/2002 | Jones et al. | |
| 6,612,936 | B1 * | 9/2003 | Matias | 473/256 |
| 7,143,780 | B1 * | 12/2006 | Pitts | 137/382 |
| 7,309,292 | B2 * | 12/2007 | Tu Teng | 473/256 |
| 8,578,562 | B2 | 11/2013 | Liu et al. | |
| 2002/0128085 | A1 * | 9/2002 | Kallassy | 473/256 |
| 2006/0282988 | A1 * | 12/2006 | Lin | 16/429 |
| 2013/0053162 | A1 * | 2/2013 | Marrero | 473/256 |
| 2015/0113767 | A1 * | 4/2015 | Yuan et al. | 16/400 |

* cited by examiner

*Primary Examiner* — Chuck Mah
(74) *Attorney, Agent, or Firm* — Alan D. Kamrath; Kamrath IP Lawfirm, P.A.

(57) ABSTRACT

A rotatable counterweight assembly is mounted on a hose and contains a body and a rotary loop. The body includes a first segment, a second segment, an outer fence formed between the first segment and the second segment, and an open channel longitudinally extending along an X axis and between the first segment and the second segment to define a first opening; a horizontal width of the channel along a Z axis allows the hose placing in the channel, and a radial depth of the channel along a Y axis allows the hose accommodating in the channel. The body also includes an installing groove defined around the outer fence and having two ends communicating with the first opening. The rotary loop is rotatably fitted in the installing groove and is rotated toward an opening position and a retaining position, and the rotary loop includes a second opening defined therein.

13 Claims, 14 Drawing Sheets

ROTATABLE COUNTERWEIGHT ASSEMBLY

FIELD OF THE INVENTION

The present invention relates to a component of a pull-out faucet, and more particularly to a rotatable counterweight assembly which is mounted on and removed from a hose of a pull-out faucet easily.

BACKGROUND OF THE INVENTION

A conventional regulator valve is fixed in a flushing system of a toilet to decrease and stabilize water pressure and water flow at a high pressure.

A conventional spray hose assembly includes a hose and a spray head, and one end of the hose is connected to a water supply source, and another end thereof is coupled to the spray head. In a normal state, the hose is fixed under a tank, and the spray head is positioned in a receiving seat of the tank so that when a user pulls the spray head, the hose extends outwardly from an opening of the receiving seat. Moreover, a counterweight assembly is installed on the hose so that the spray head returns back to the receiving seat when in no use by using the counterweight assembly's weight.

Two conventional counterweight structures are individually disclosed in U.S. Pat. No. 6,460,570 B1 and U.S. Pat. No. 8,578,562 B2, and they are one-piece formed or are comprised of two parts but cannot be retained on or removed from a hose easily.

Another conventional counterweight assembly is disclosed in U.S. Pat. No. 8,578,562 B2 and is mounted on a hose by screwing outer threads of a retainer with inner threads of a locking element. However, the conventional counterweight assembly cannot be mounted on the hose tightly or it removes from the hose easily. Furthermore, the outer threads of the retainer and the inner threads of the locking element are machined at high production cost.

The present invention has arisen to mitigate and/or obviate the afore-described disadvantages.

SUMMARY OF THE INVENTION

One aspect of the present invention is to provide a rotatable counterweight assembly which is mounted on a hose of a faucet easily and quickly.

To obtain the above aspects, a rotatable counterweight assembly provided by the present invention is mounted on a hose and contains: a body and a rotary loop.

The body includes a first segment, a second segment, an outer fence formed between the first segment and the second segment; an open channel longitudinally extending along an X axis and between the first segment and the second segment to define a first opening; a horizontal width of the channel along a Z axis allowing the hose placing in the channel, and a radial depth of the channel along a Y axis allowing the hose accommodating in the channel; and an installing groove defined around the outer fence and having two ends communicating with the first opening.

The rotary loop is rotatably fitted in the installing groove of the body and is rotated toward an opening position and a retaining position, and the rotary loop includes a second opening defined therein; wherein when the rotary loop is rotated toward the opening position, the second opening of the rotary loop faces to the first opening of the body and allows the hose passing through the second opening and the first opening; when the rotary loop is rotated toward the retaining position, it closes the first opening and retains the hose in the channel.

Thereby, the rotary loops of the present inventions are rotated between the opening position and the retaining position to fix the counterweight assembly on the hose or to remove the counterweight assembly from the hose easily and quickly.

In addition, the rotary loops of the present invention have the gripping face to be manually grasped easily without using any tool.

The angle between the opening position and the retaining position of the rotary loops of the present inventions are 90 to 150 degrees so that the rotary loops are rotated less one circle (i.e., 360 degrees) to retain the rotary loops with the hose quickly.

The counterweight assembly of the present invention only contains the body and the rotary loop to simplify a number of components, thus lowering material and production costs.

The forcing structure of the rotary loops retains the rotary loop with the hose tightly to avoid the counterweight assembly removing from the hose after a long period of using time.

The rotary loops have the contacting section with the thickness, such that when the rotary loops are rotated toward the retaining position, it retains with the hose by ways of the plural vertical ribs and the thickness of the contacting section.

A retaining force between each of the rotary loops and the hose is fixed to prevent damaging the hose.

DETAILED DESCRIPTION OF THE PREFERRED EMBODIMENTS

Figure 1:
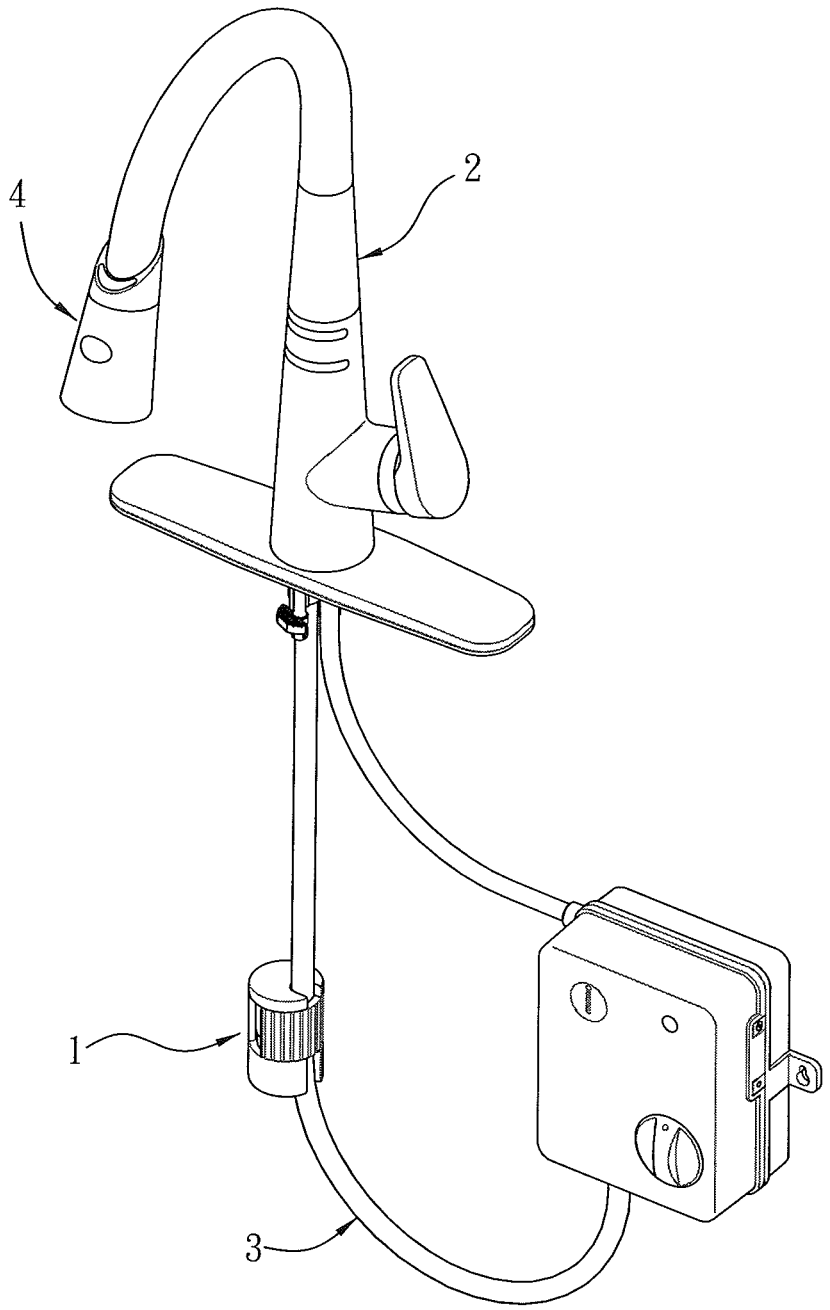
FIG. 1 is a perspective view showing a rotatable counterweight assembly being mounted on a pull-out faucet according to a first embodiment of the present invention.

With reference to FIG. 1, a rotatable counterweight assembly 1 according to a first embodiment of the present invention is mounted on a hose 3 of a faucet 2, and the hose 3 is in connection with a pull-out spray head 4 for spraying water from the hose 3.

Figure 2:
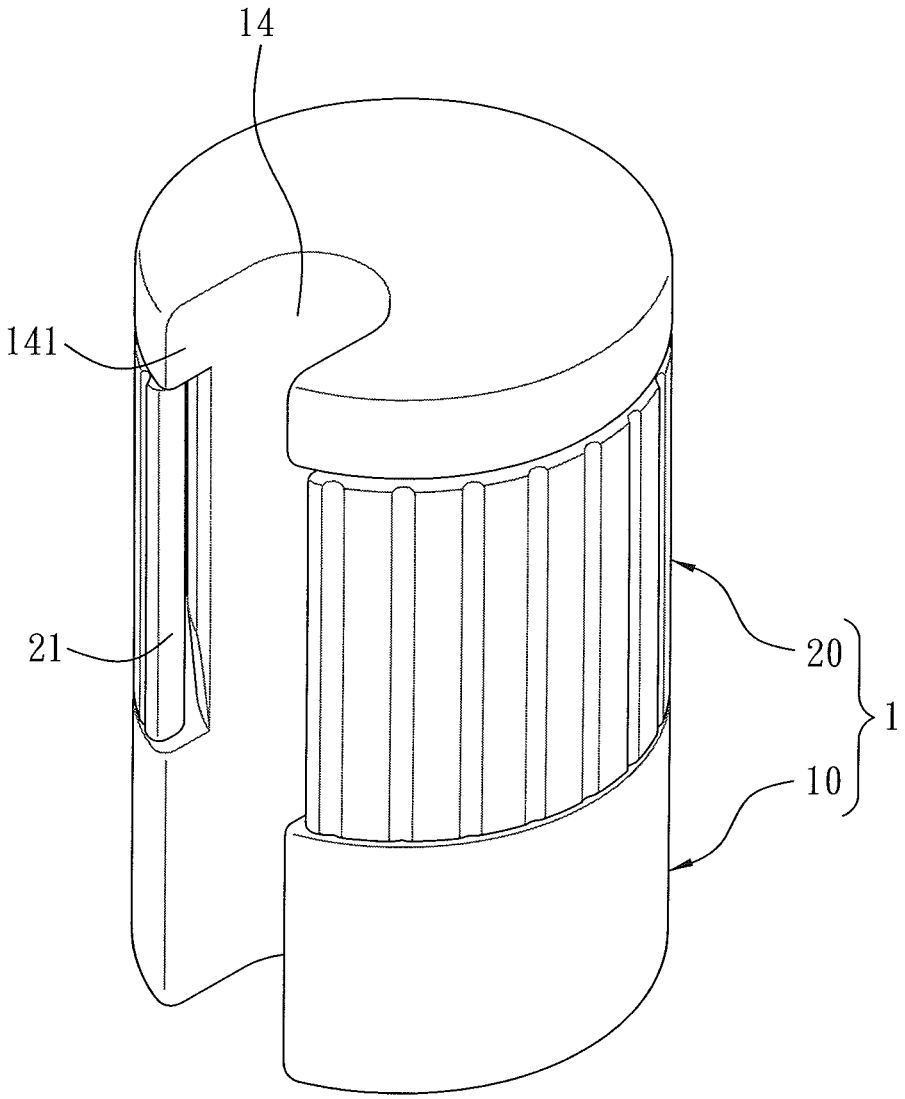
FIG. 2 is a perspective view showing the assembly of the rotatable counterweight assembly according to a first embodiment of the present invention.
Figure 3:
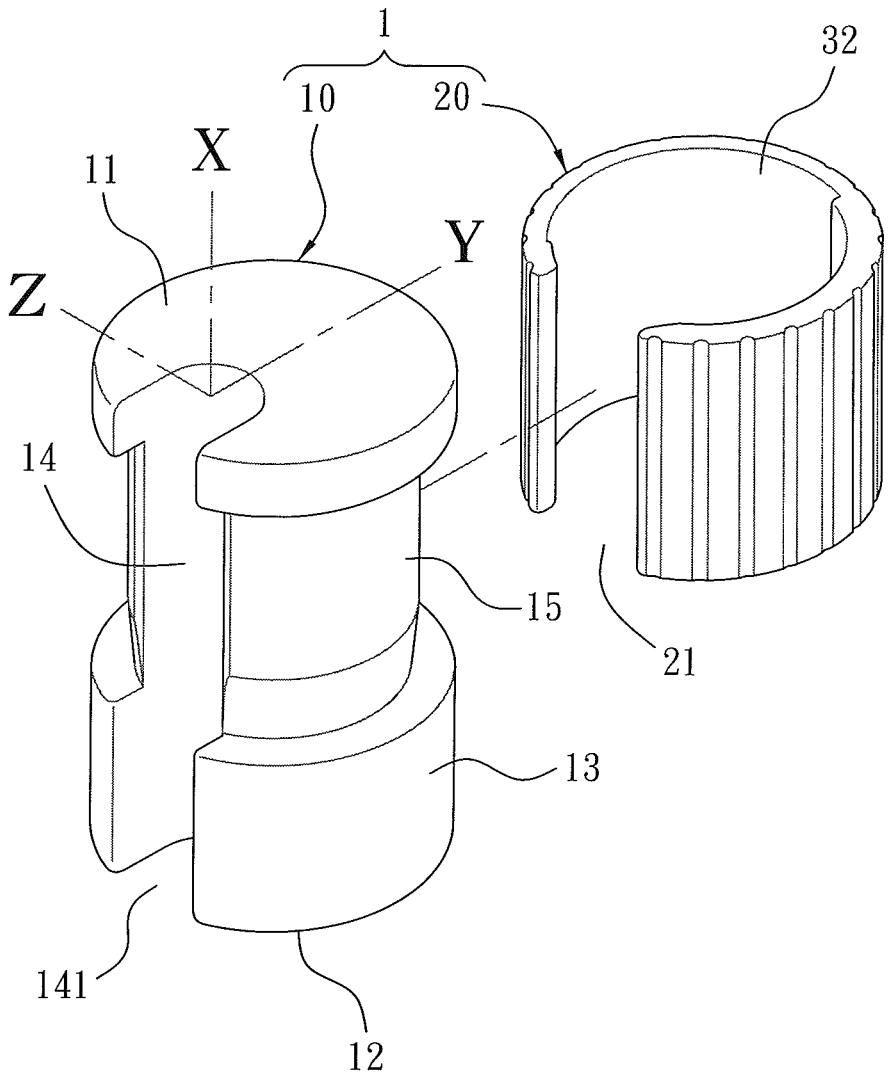
FIG. 3 is a perspective view showing the exploded components of the rotatable counterweight assembly according to the first embodiment of the present invention.
Figure 4:
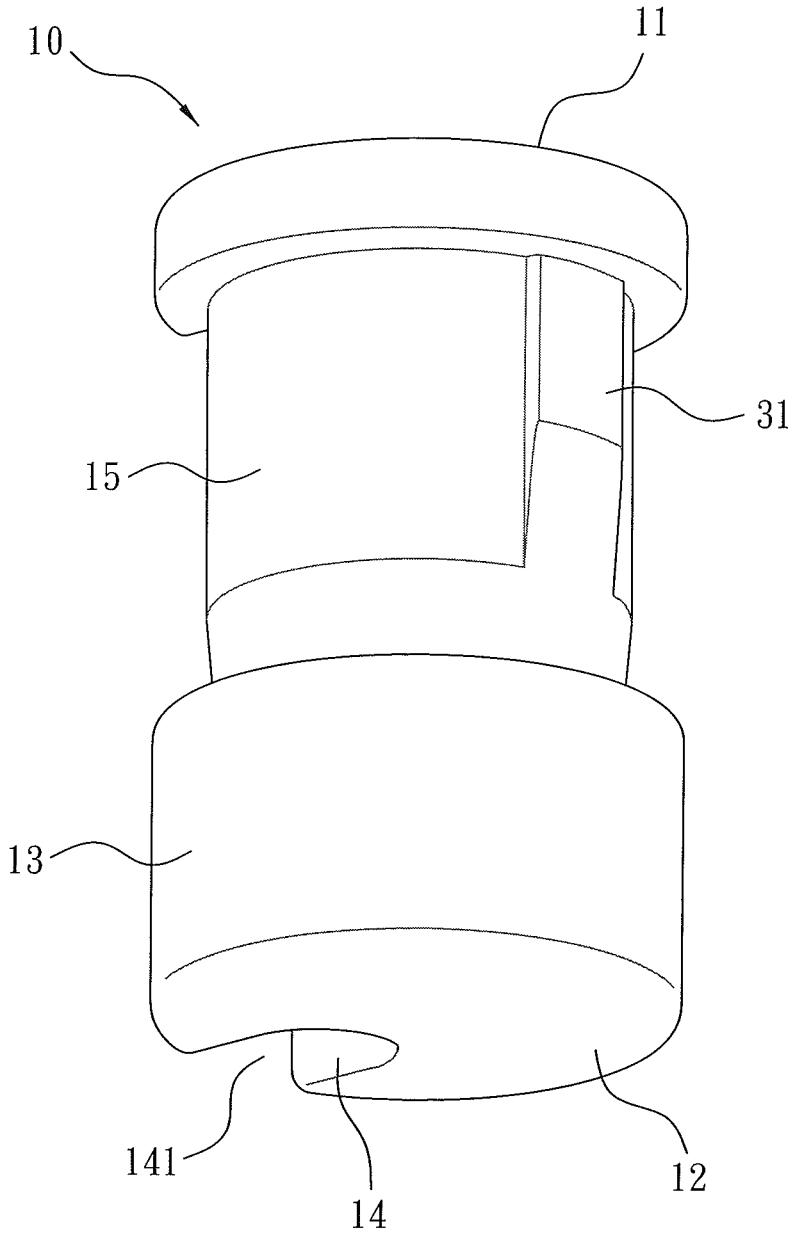
FIG. 4 is a perspective view showing the assembly of the rotatable counterweight assembly according to the first embodiment of the present invention.
Figure 5:
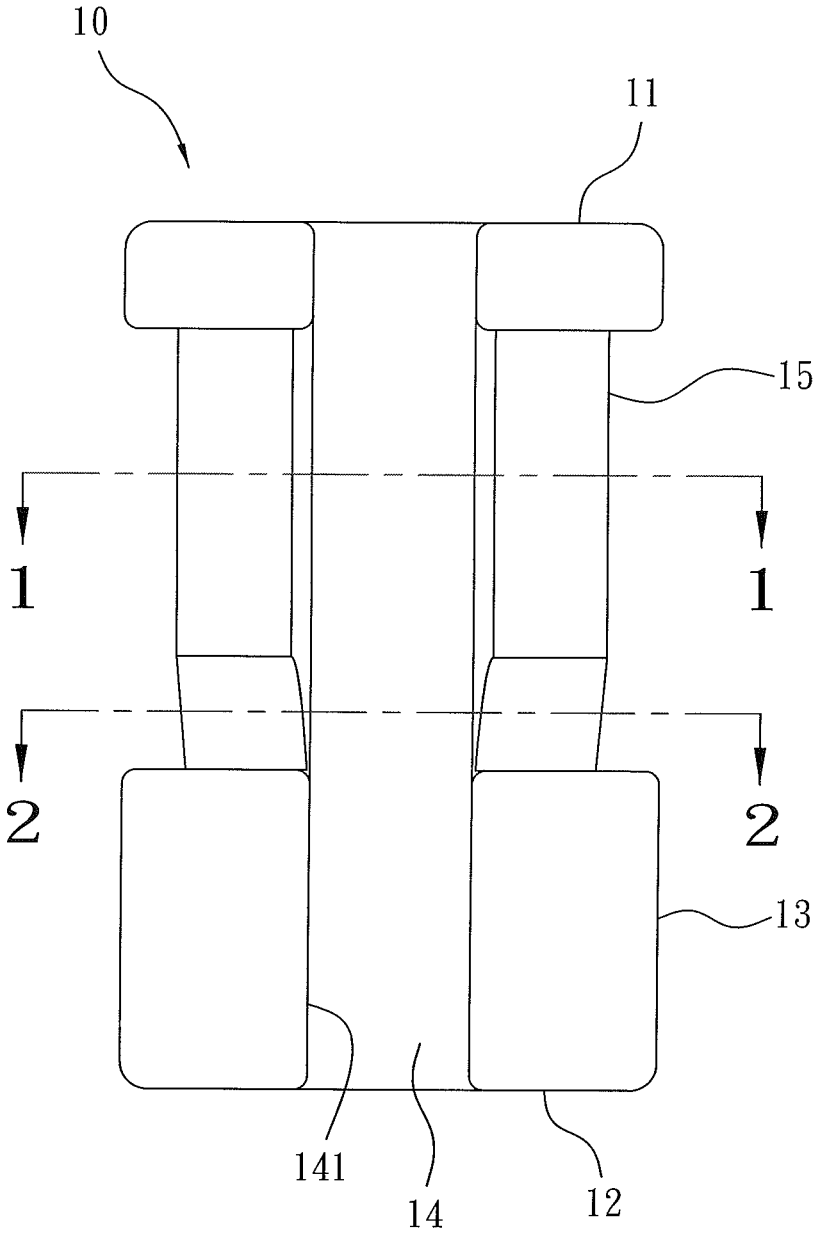
FIG. 5 is a side plan view showing the assembly of the rotatable counterweight assembly according to the first embodiment of the present invention.

Referring to FIGS. 2 and 3, the rotatable counterweight assembly 1 comprises a body 10 and a rotary loop 20.

The body 10, as shown in FIGS. 4 to 7, includes a first segment 11, a second segment 12, an outer fence 13 formed between the first segment 11 and the second segment 12; an open channel 14 longitudinally extending along an X axis and between the first segment 11 and the second segment 12 to define a first opening 141, wherein a horizontal width W of the channel 14 along a Z axis allows the hose 3 placing in the channel 14, and a radial depth D of the channel 14 along a Y axis allows the hose 3 accommodating in the channel 14; and an installing groove 15 defined around the outer fence 13 and having two ends communicating with the first opening 141.

Figure 8:
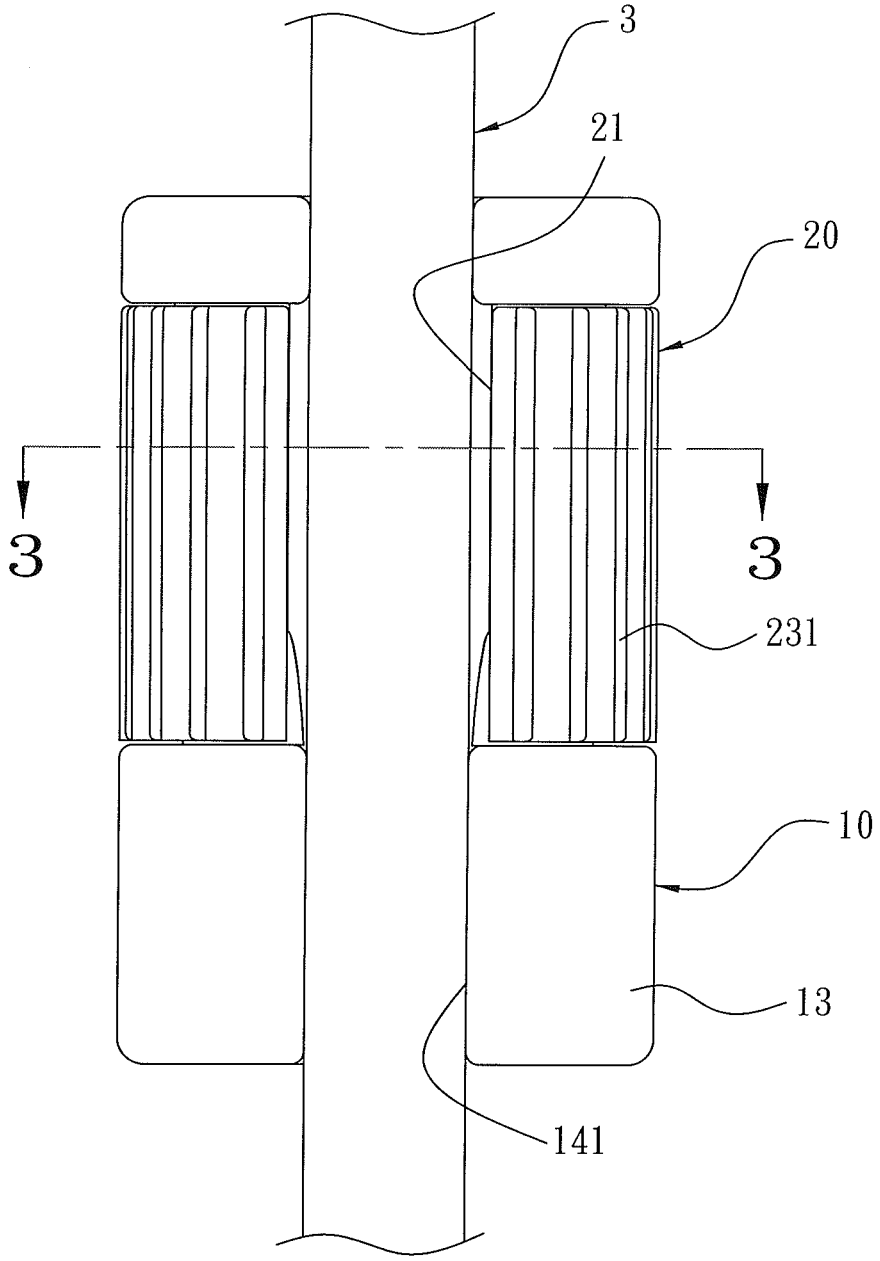
FIG. 8 is a side plan view showing the operation of the rotatable counterweight assembly according to the first embodiment of the present invention.
Figure 9:
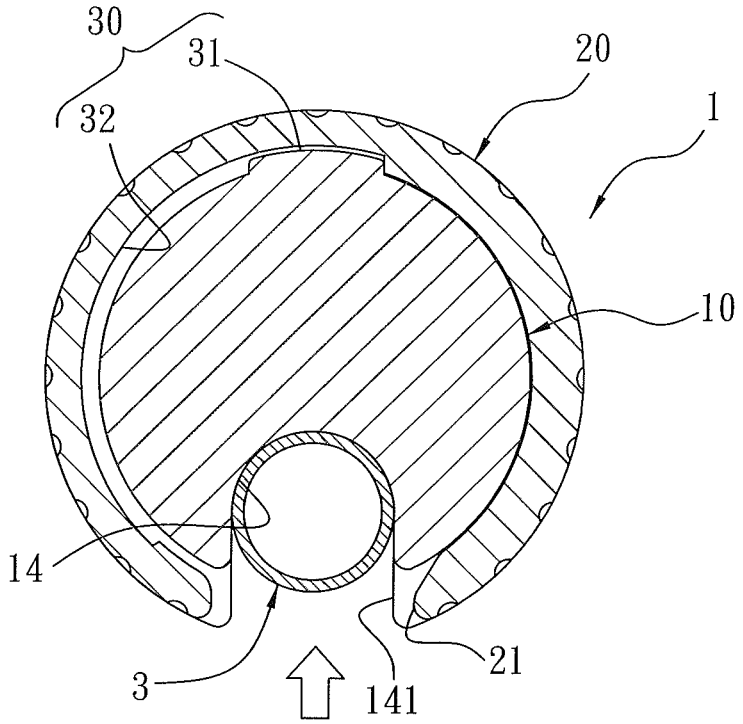
FIG. 9 is a cross sectional view taken along the lines 3-3 of FIG. 8.
Figure 12:
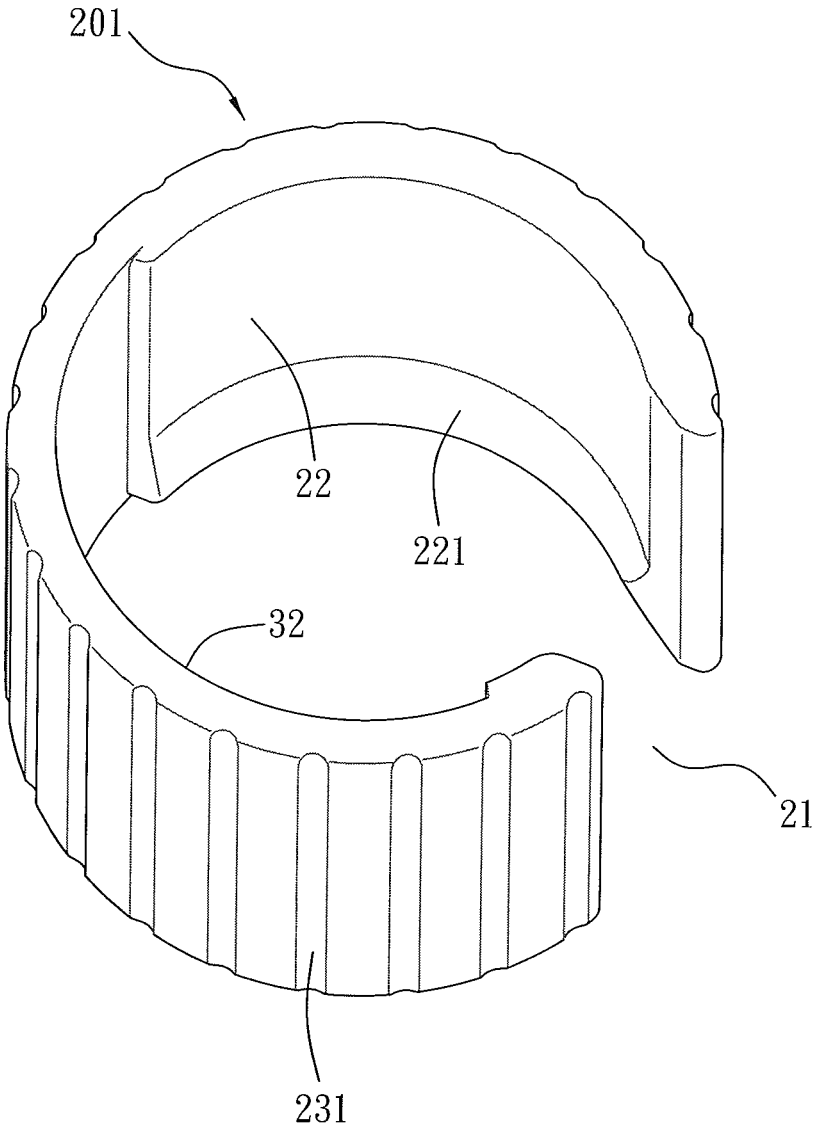
FIG. 12 is a perspective view showing the assembly of a rotary loop of the rotatable counterweight assembly according to the first embodiment of the present invention.
Figure 13:
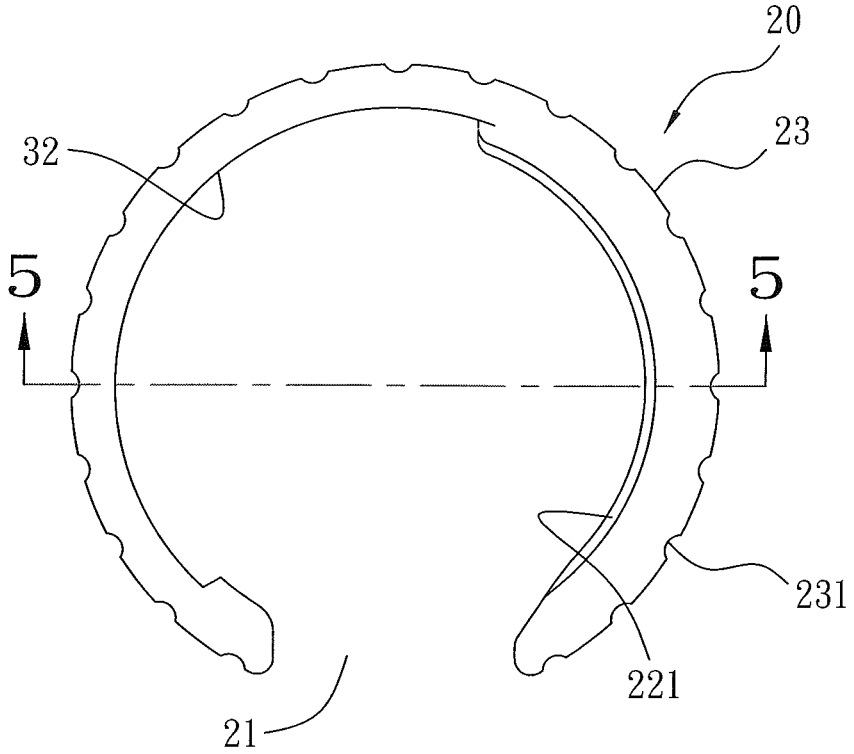
FIG. 13 is a top plan view showing the operation of the rotatable counterweight assembly according to the first embodiment of the present invention.
Figure 14:
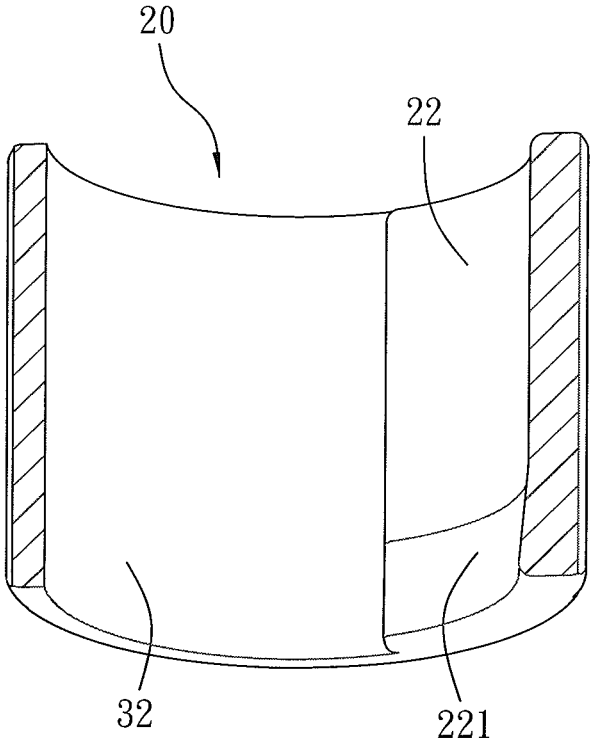
FIG. 14 is a cross sectional view taken along the lines 5-5 of FIG. 13.

The rotary loop 20, as illustrated in FIGS. 12 to 14, is rotatably fitted in the installing groove 15 of the body 10 and is rotated toward an opening position as shown in FIGS. 8 and 9, and the rotary loop 20 is also rotated toward a retaining position and is formed in a C shape. In addition, the rotary loop 20 includes a second opening 21 defined therein. When the rotary loop 20 is rotated toward the opening position, the second opening 21 of the rotary loop 20 faces to the first opening 141 of the body 10 and allows the hose 3 passing through the second opening 21 and the first opening 141. When the rotary loop 20 is rotated toward the retaining position, it closes the first opening 141 and retains the hose 3 in the channel 14.

Figure 6:
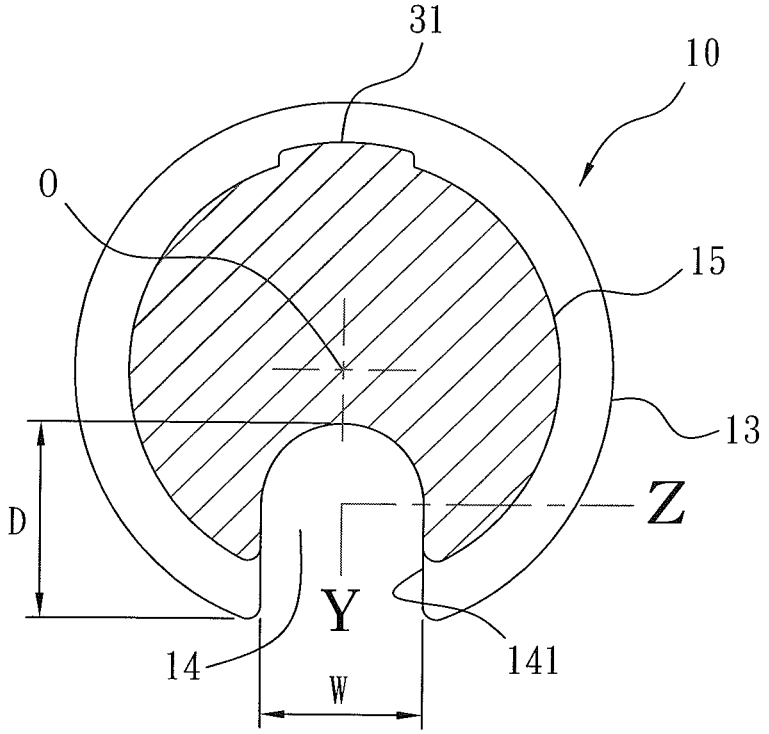
FIG. 6 is a cross sectional view taken along the lines 1-1 of FIG. 5.
Figure 7:
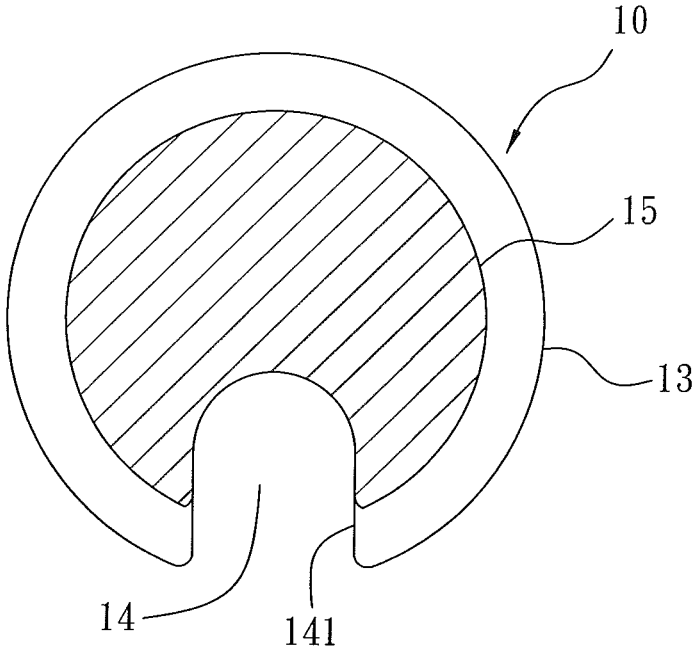
FIG. 7 is a cross sectional view taken along the lines 2-2 of FIG. 5.

With reference to FIG. 6, the radial depth D of the channel 14 does not reach to a central axis O of the body 10, hence when the counterweight assembly 1 is mounted on the hose 3, the body 10 is selectively slanted toward a desired position on one side of the hose 3 to avoid the counterweight assembly 1 touching an obstacle (such as a cold-water inlet pipe, a hot-water inlet pipe, and a mixed-water outlet pipe), when the hose 3 is moved upwardly or downwardly. When the body 10 is moved downwardly, a center of gravity of the counterweight assembly 1 is located below the hose 3 so that the counterweight assembly 1 is moved stably with a movement of the hose 3.

Figure 11:
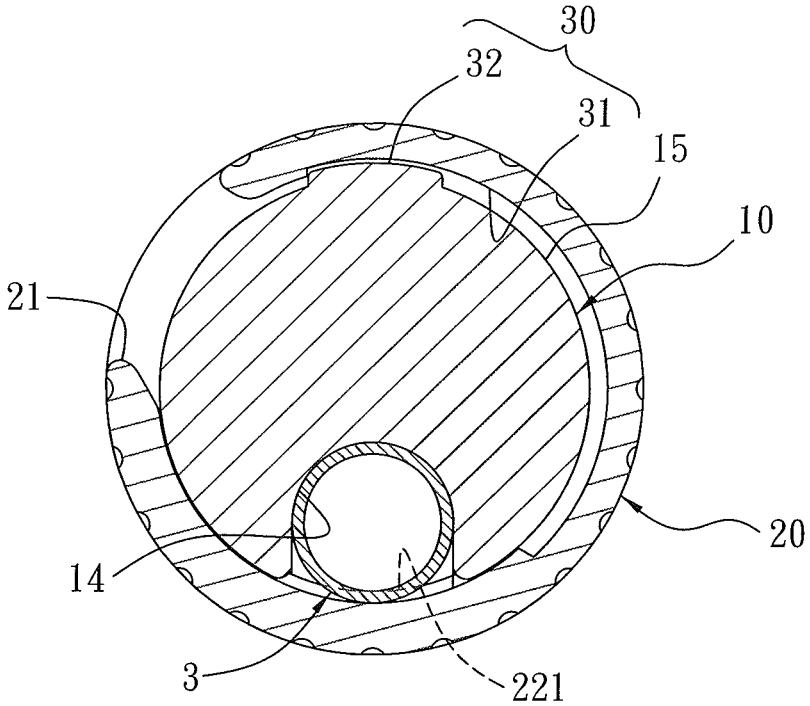
FIG. 11 is a cross sectional view taken along the lines 4-4 of FIG. 10.

To limit a rotation of the rotary loop 20 between the opening position and the retaining position, a limiting structure 30 is defined between the outer fence 13 of the body 10 and an inner fence 22 of the rotary loop 20, as shown in FIGS. 9 and 11, such that the rotary loop 20 is rotated relative to the body 10 and between the opening position and the retaining position. The limiting structure 30 includes a defining block 31 and a confining recess 32. The defining block 31 one-piece extends on the outer fence 13 of the body 10, and the confining recess 32 is one-piece defined on the inner fence 22 of the rotary loop 20 to accommodate the defining block 31 and to retain with the defining block 31, thus rotating the rotary loop 20 between the opening position and the retaining position.

It is to be noted that an angle between the opening position and the retaining position of the rotary loop 20 is 120 degrees. In other words, the rotary loop 20 is rotated within 120 degrees. However, the angle between the opening position and the retaining position of the rotary loop 20 can be 90 to 150 degrees.

With reference to FIGS. 12 to 14, the inner fence 22 of the rotary loop 20 has a forcing structure 221 for retaining the rotary loop 20 with the hose 3 tightly, when the rotary loop 20 is rotated toward the retaining position. The forcing structure 221 is a tilted rib horizontally extending along the inner fence 22, such that the rotary loop 20 retains with the hose 3 matingly to avoid the counterweight assembly 1 removing from the hose 3 after a long period of using time.

The outer fence 23 of the rotary loop 20 has a gripping face for grasping the rotary loop 20 stably, and the gripping face of the outer fence 23 has a plurality of anti-slip slots 231 longitudinally extending along the X axis as shown in FIGS. 12 and 13.

The rotary loop 20 is one-piece made of flexible material, such as plastic material or metal material, such that the second opening 21 is expanded, and the rotary loop 20 is fitted in the installing groove 15 of the body 10 via the second opening 21.

Figure 10:
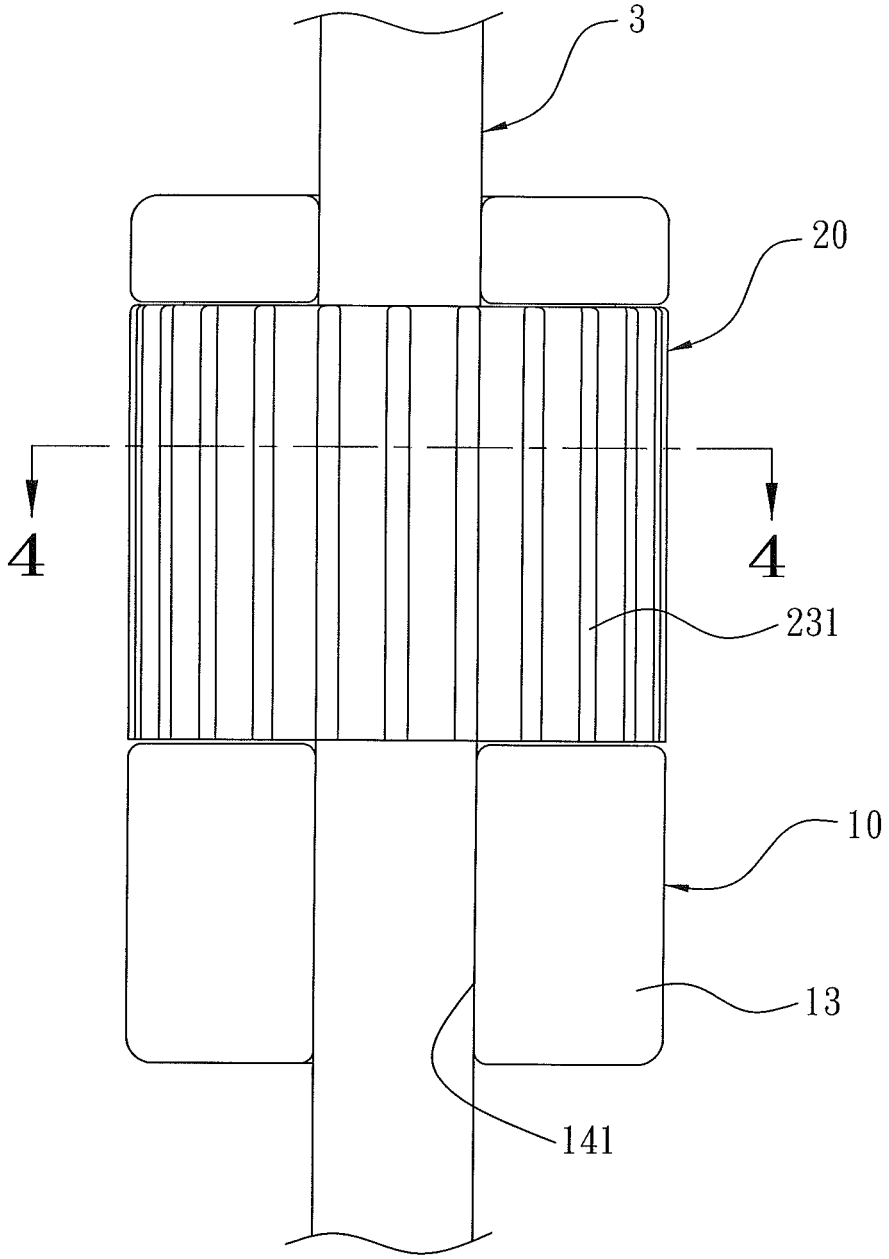
FIG. 10 is a side plan view showing the operation of the rotatable counterweight assembly according to the first embodiment of the present invention.

Since the rotary loop 20 is fitted in the installing groove 15 of the body 10, in assembly, the rotary loop 20 is rotated toward the opening position, as shown in FIG. 2, such that the second opening 21 of the rotary loop 20 faces to the first opening 141 of the body 10, and the second opening 21 of the rotary loop 20 is aligned with the hose 3 to retain the rotary loop 20 with the hose 3, as illustrated in FIGS. 8 and 9, the hose 3 is accommodated in the channel 14 of the body 10 through the second opening 21 and the first opening 141, the rotary loop 20 is rotated toward the retaining position by grasping the gripping face of the rotary loop 20 as shown in FIGS. 10 and 11, such that the forcing structure 221 of the inner fence 22 of the rotary loop 20 engages with the hose 3, and the hose 3 is fitted in the channel 14 of the body 10 quickly.

After rotating the rotary loop 20 toward the opening position, the second opening 21 of the rotary loop 20 faces to the first opening 141 of the body 10 so that the hose 3 is removed from the channel 14 of the body 10 quickly.

Figure 15:
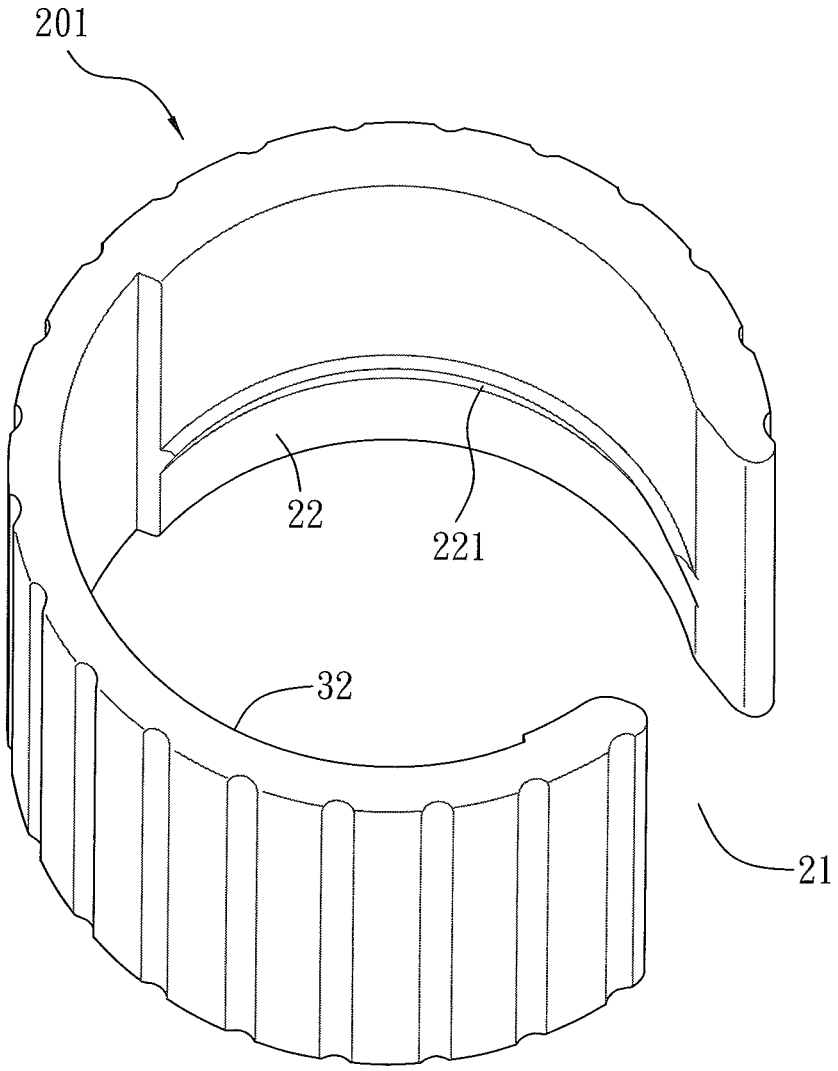
FIG. 15 is a perspective view showing the assembly of a rotary loop of the rotatable counterweight assembly according to a second embodiment of the present invention.

Referring to FIG. 15, a rotatable counterweight assembly 1 of a second embodiment from that of the first embodiment comprises: a forcing structure 221 of an inner fence 22 of a rotary loop 201 being an inversely hooked rib horizontally extending along the inner fence 22.

Figure 16:
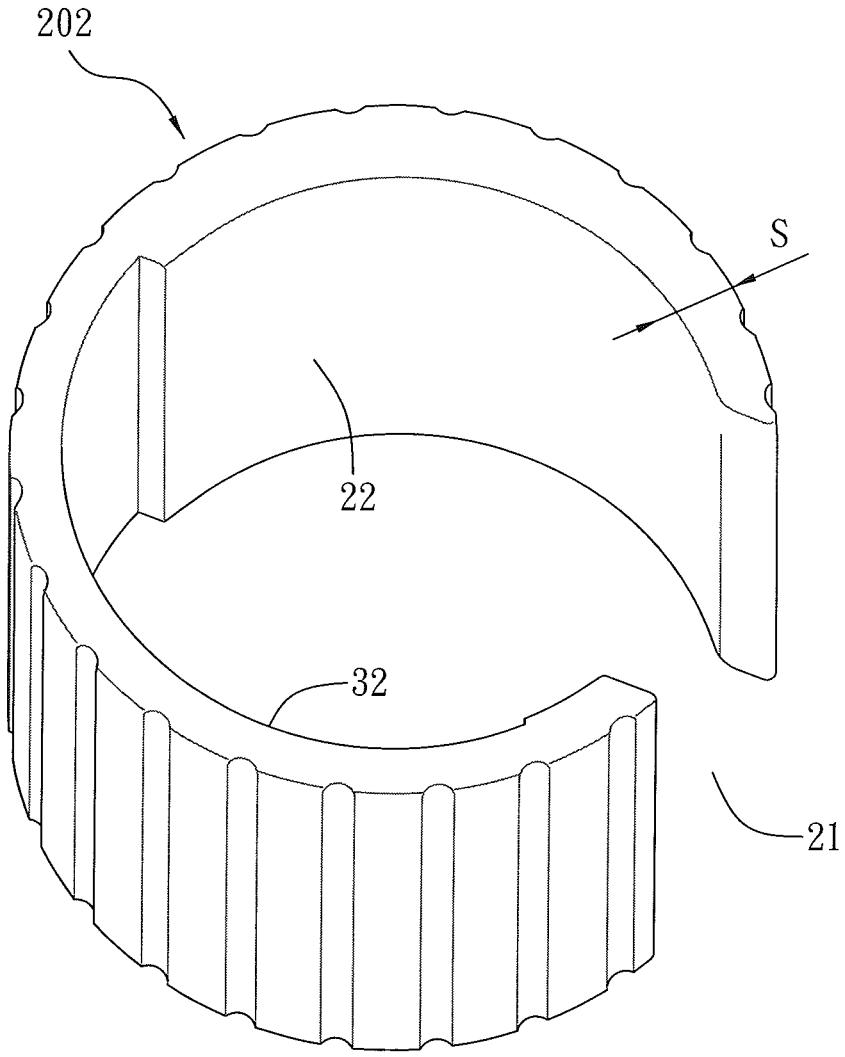
FIG. 16 is a perspective view showing the assembly of a rotary loop of the rotatable counterweight assembly according to a third embodiment of the present invention.
Figure 17:
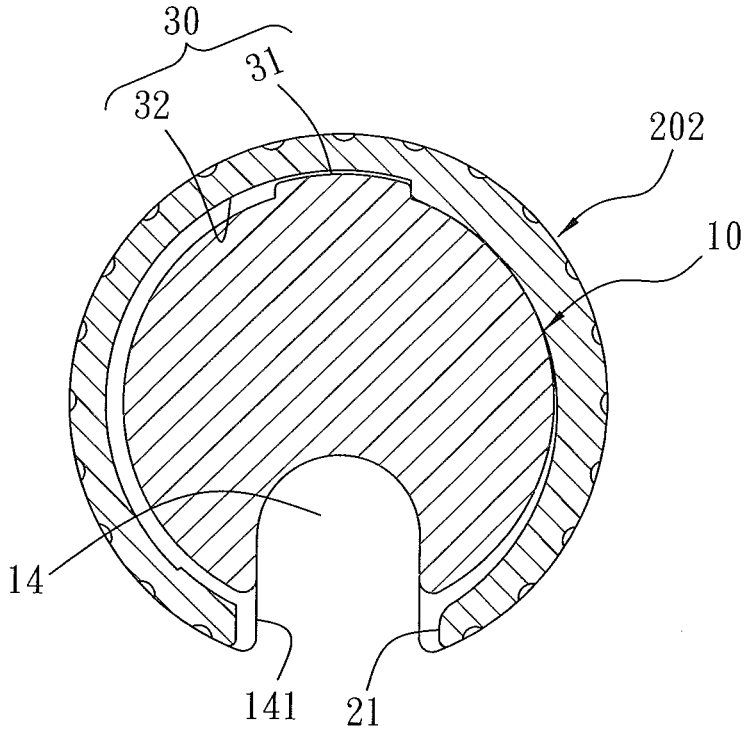
FIG. 17 is a cross sectional view showing the rotary loop of the rotatable counterweight assembly being fitted in an installing groove according to the third embodiment of the present invention.

As shown in FIGS. 16 and 17, a rotatable counterweight assembly 1 of a third embodiment from that of the first embodiment comprises: a contacting section S with a thickness increasing from a first side of a second opening 21 toward a second side of the second opening 21, such that when a rotary loop 202 is rotated from the opening opposition toward the retaining position, it retains with the hose 3 gradually.

When the rotary loop 20 of the first embodiment and the rotary loop 201 of the second embodiment are rotated toward the retaining position, the defining block 31 retains with the confining recess 32. But in this embodiment, when the rotary loop 202 is rotated toward the retaining position, it pushes the hose 3 gradually and finally retains with the hose 3, such that the retaining position of this third embodiment replaces the retaining position of the first embodiment and the second embodiment where the defining block 31 retains with the confining recess 32.

Figure 18:
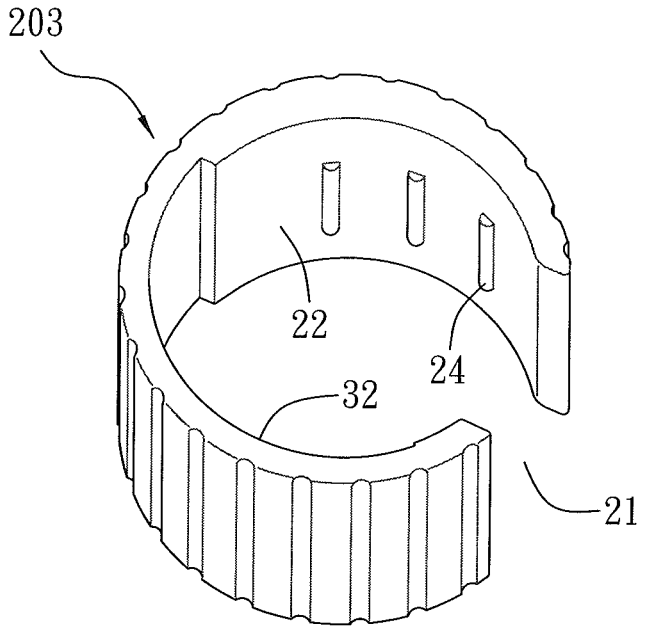
FIG. 18 is a perspective view showing the assembly of a rotary loop of the rotatable counterweight assembly according to a fourth embodiment of the present invention.

As shown in FIG. 18, a rotatable counterweight assembly 1 of a fourth embodiment from that of the third embodiment comprises: an inner fence 22 of a rotary loop 203 having plural vertical ribs 24 longitudinally extending along an X axis, and the vertical ribs 24 are spaced apart around the inner fence 22 of the rotary loop 203, such that when the rotary loop 20 is rotated toward the retaining position, it retains with the hose 3 by ways of the plural vertical ribs 24.

Thereby, the rotary loops 20, 201, 202, 203 of the present inventions are rotated between the opening position and the retaining position to fix the counterweight assembly 1 on the hose 3 or to remove the counterweight assembly 1 from the hose 3 easily and quickly.

In addition, the rotary loops 20, 201, 202, 203 of the present invention have the gripping face to be manually grasped easily without using any tool.

The angle between the opening position and the retaining position of the rotary loops 20, 201, 202, 203 of the present inventions are 90 to 150 degrees so that the rotary loops 20, 201, 202, 203 are rotated less one circle (i.e., 360 degrees) to retain the rotary loops 20, 201, 202, 203 with the hose 3 quickly.

The counterweight assembly 1 of the present invention only comprises the body 10 and the rotary loop 20, 201, 202 or 203 to simplify a number of components, thus lowering material and production costs.

The forcing structure 221 of the rotary loops 20, 201 retains the rotary loop 20, 201 with the hose 3 tightly to avoid the counterweight assembly 1 removing from the hose 3 after a long period of using time.

The rotary loops 202, 203 have the contacting section S with the thickness, such that when the rotary loops 202, 203 are rotated toward the retaining position, it retains with the hose 3 by ways of the plural vertical ribs 24 and the thickness of the contacting section S.

A retaining force between each of the rotary loops 201, 202, 203 and the hose 3 is fixed to prevent damaging the hose 3.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A rotatable counterweight assembly being mounted on a hose and comprising:

a body including a first segment, a second segment, an outer fence formed between the first segment and the second segment; an open channel longitudinally extending along an X axis of the body and between the first segment and the second segment to define a first opening; a horizontal width of the channel along a Z axis of the body configured to place the hose in the channel, and a radial depth of the channel along a Y axis of the body configured to accommodate the hose in the channel; and an installing groove defined around the outer fence of the body and having two ends communicating with the first opening;

a rotary loop rotatably fitted in the installing groove of the body and rotated toward an opening position and a retaining position, and the rotary loop including a second opening defined therein; wherein when the rotary loop is rotated toward the opening position, the second opening of the rotary loop faces to the first opening of the body and allows the hose passing through the second opening and the first opening; when the rotary loop is rotated toward the retaining position, it closes the first opening and retains the hose in the channel;

wherein between the outer fence of the body and an inner fence of the rotary loop is defined a limiting structure for limiting a rotation of the rotary loop between the opening position and the retaining position and relative to the body.

2. The rotatable counterweight assembly as claimed in claim 1, wherein the rotary loop is formed in a C shape.

3. The rotatable counterweight assembly as claimed in claim 1, wherein the limiting structure includes a defining block one-piece extending on the outer fence of the body and includes a confining recess one-piece defined on the inner fence of the rotary loop to accommodate the defining block and to retain with the defining block, thus rotating the rotary loop between the opening position and the retaining position.

4. The rotatable counterweight assembly as claimed in claim 1, wherein an angle between the opening position and the retaining position of the rotary loop is 90 to 150 degrees.

5. The rotatable counterweight assembly as claimed in claim 1, wherein the angle between the opening position and the retaining position of the rotary loop is 120 degrees.

6. The rotatable counterweight assembly as claimed in claim 1, wherein an inner fence of the rotary loop has a forcing structure for retaining the rotary loop with the hose tightly.

7. The rotatable counterweight assembly as claimed in claim 6, wherein the forcing structure is a tilted rib horizontally extending along the inner fence.

8. The rotatable counterweight assembly as claimed in claim 6, wherein the forcing structure is an inversely hooked rib horizontally extending along the inner fence.

9. The rotatable counterweight assembly as claimed in claim 1, wherein the rotary loop has a contacting section with a thickness increasing from a first side of the second opening toward a second side of the second opening, such that when the rotary loop is rotated from the opening opposition toward the retaining position, it retains with the hose gradually.

10. The rotatable counterweight assembly as claimed in claim 9, wherein an inner fence of the rotary loop has plural vertical ribs longitudinally extending parallel to the X axis of the body, and the vertical ribs are spaced apart around the inner fence of the rotary loop, such that when the rotary loop is rotated toward the retaining position, it retains with the hose by ways of the plural vertical ribs.

11. The rotatable counterweight assembly as claimed in claim 1, wherein a radial depth of the channel does not reach to a central axis of the body, hence when the counterweight assembly is mounted on the hose, the body is slanted toward one side of the hose.

12. The rotatable counterweight assembly as claimed in claim 1, wherein an outer fence of the rotary loop has a gripping face for grasping the rotary loop stably.

13. The rotatable counterweight assembly as claimed in claim 12, wherein the gripping face of the outer fence of the rotary loop has a plurality of anti-slip slots longitudinally extending along the X axis relative to the body.

* * * * *